United States Patent [19]

Umezaki

[11] Patent Number: 4,866,409

[45] Date of Patent: Sep. 12, 1989

[54] RESIN-CRACK PREVENTED HIGH-VOLTAGE TRANSFORMER

[75] Inventor: Tomokazu Umezaki, Himeji, Japan

[73] Assignee: Mitsubishi Denki Kabushiki Kaisha, Japan

[21] Appl. No.: 128,417

[22] Filed: Dec. 3, 1987

[51] Int. Cl.[4] ..... H01F 27/02; H01F 27/26

[52] U.S. Cl. ..... 336/96; 336/178; 336/212

[58] Field of Search ..... 336/96, 107, 105, 205, 336/178, 215, 216, 212, 92; 123/634, 635; 264/272.19

[56] References Cited

U.S. PATENT DOCUMENTS

| | | | |
|---|---|---|---|
| 2,412,102 | 12/1946 | Spengler | 336/96 X |
| 4,019,167 | 4/1977 | Baker | 336/96 |
| 4,199,743 | 4/1980 | Martincic | 336/96 |
| 4,516,559 | 5/1985 | Oohashi | 123/634 |
| 4,523,171 | 6/1985 | Altmann et al. | 336/96 |

FOREIGN PATENT DOCUMENTS

| | | | |
|---|---|---|---|
| 1077778 | 3/1960 | Fed. Rep. of Germany | 336/96 |
| 3423524 | 1/1986 | Fed. Rep. of Germany | 336/178 |
| 1058103 | 3/1954 | France | 336/178 |
| 662711 | 12/1951 | United Kingdom | 336/178 |
| 749370 | 5/1956 | United Kingdom | 336/96 |

*Primary Examiner*—Thomas J. Kozma

*Attorney, Agent, or Firm*—Leydig, Voit & Mayer

[57] ABSTRACT

In a high-voltage transformer such as an ignition coil for internal combustion engines, a resin-crack preventing member is provided between an iron core and a resin which is impregnated into a coil case for electrically insulating a primary coil and a secondary coil in the coil case from the iron core as well as for firmly securing these coils and the iron core to the coil case. The resin-crack preventing member is moulded from a resinous material which is highly adhesive to the impregnated resin and which has a coefficient of thermal expansion similar to that of the impregnated resin. The resin-crack preventing member serves to prevent direct contact of the impregnated resin with the corners, side surfaces and inner surface of the iron core which has a coefficient of thermal expansion substantially different from that of the impregnated resin, thereby avoiding peeling off and cracking in the impregnated resin which would otherwise be caused by severe temperature changes. As a result, degradation of the electrical insulation of the transformer is effectively prevented.

13 Claims, 5 Drawing Sheets

RESIN-CRACK PREVENTED HIGH-VOLTAGE TRANSFORMER

BACKGROUND OF THE INVENTION

1. Field of the Invention

This invention relates to a high-voltage transformer such as an ignition coil for internal combustion engines in which a primary coil, a secondary coil and an iron core are electrically insulated from each other and firmly installed in and secured to a coil case by a resin impregnated therein.

2. Description of the Prior Art

FIG. 1 is a plan view showing a conventional high-voltage transformer for internal combustion engines, and FIG. 2 is a cross sectional view taken along line II—II of FIG. 1. In these figures, the high-voltage transformer 1 in the form of an ignition coil comprises a generally cylindrical coil case 2 formed of a synthetic resin, a primary coil 3 in the coil case 2, a secondary coil 4 disposed in the coil case 2 so as to surround the primary coil 3, a cylindrical sleeve 5 disposed in and fixedly mounted on the coil case 2 substantially at the center thereof for receiving an unillustrated rotary shaft of a distributor, and an iron core 6 disposed in the coil case 2 around the sleeve 5 so as to surround the primary coil 3 and the secondary coil 4.

The iron core 6 comprises an annular inner or central leg portion 601 disposed around the cylindrical sleeve 5 and radially inside the primary coil 3, four planar outer leg portions 602 disposed radially outside the secondary coil 4, a pair of first (or lower) and second (or upper) cross-shaped arm portions 603 and 604 interconnecting the inner and outer leg portions 601 and 602 for forming a closed magnetic path which passes through the primary and secondary coils 3, 4 when these coils are energized. The annular inner leg portion 601 is in contact at its opposite ends with the inner surfaces of the lower and upper arm portions 603, 604. The outer leg portions 602 are slightly shorter than the inner leg portion 601 so that they are in contact at their lower end with the cross-shaped lower arm portion 603 but spaced from the upper arm portion 604 with a limited gap 605 formed therebetween.

A resin 7 is filled into the coil case 2 and impregnated into the spaces between the coils 3, 4 and the iron core 6 for electrically insulating the coils 3, 4 and the iron core 6 from each other as well as for firmly securing or bonding them to the coil case 2. In this case, the lower arm portion 603 of the iron core 6 is moulded integrally with or otherwise firmly connected with the coil case 2, and it is exposed to the outside of the coil case 2 for dissipating heat which is generated during moulding of the coil case 2.

With the conventional high-voltage transformer 1 as constructed above, the lower cross-shaped arm portion 603 of the iron core 6 is first disposed in and integrally moulded or otherwise firmly connected with the coil case 2, and then the annular inner leg portion 601, the primary coil 3, the secondary coil 4 and the outer leg portion 602 are disposed in the coil case 2. Thereafter, the upper arm portion 604 of the iron core 6 is placed on the inner and outer leg portions 601, 602, and the resin 7 in a molten state is filled into the coil case 2 up to a predetermined level, impregnated into the spaces between the above members and solidified to firmly install these members in the coil case 2. In this manner, the resin 7 thus impregnated serves not only for securing the members to the coil case 2 but also for improving the electrical insulation therebetween.

In general, the high-voltage transformer 1 for internal combustion engines is frequently subject to temperature changes which arise, for example, between day and night, between seasons or the like. Further, the transformer 1 is repeatedly subject to great head shocks from an engine during the travel of a vehicle on which the transformer 1 and the engine are installed. As a result, due to the fact that the resin 7 has a coefficient of thermal expansion substantially different from that of the iron core 6, the resin 7 is liable to be peeled off at the contacting surfaces between the resin 7 and the side surfaces of the upper arm portion 604 of the iron core 6 or cracks will arise particularly at the inside corners of the upper arm portion 604. The peeling off of the resin 7 or the cracks thus created therein would deteriorate the electrical insulation of the resin 7, causing a leakage or reduction of high voltage at the secondary coil 4. Accordingly, there arises a problem in that a high voltage required for ignition plugs of the engine can not be obtained, resulting in engine trouble.

SUMMARY OF THE INVENTION

The present invention is intended to obviate the above-described problems of the prior art, and has for its object the provision of a resin-crack prevented high-voltage transformer in which peeling off and cracking of a resin impregnated in a coil case can be effectively prevented particularly in the neighborhood of an iron core, thereby avoiding deterioration of the electric insulation resulting therefrom.

In order to achieve the above object, the present invention provides a high-voltage transformer which comprises:

a coil case;

a primary coil in the coil case;

a secondary coil disposed in the coil case to surround the primary coil;

a cylindrical sleeve disposed in and fixedly mounted on the coil case substantially at the center thereof for receiving a rotary shaft;

iron core means disposed in the coil case around the sleeve so as to surround the primary coil and the secondary coil and adapted to form a closed magnetic path passing through the primary and secondary coils when these coils are energized;

a resin impregnated in the coil case for electrically insulating the coils from the iron core means and for securing the coils and the iron core means to the coil case; and a resin-crack preventing means disposed between the impregnated resin and at least a portion of the iron core means for preventing the peeling off and cracking of the resin.

In the present invention, on the interface between the iron core and the surface of the impregnated resin where peeling off and cracking of the resin are apt to arise, there is provided the means for preventing resin cracks, which has a coefficient of thermal expansion similar to that of the impregnated resin and is highly adhesive to the impregnated resin. Therefore, the portion of the impregnated resin which is readily peelable and crackable can be secured to the iron core through the resin-crack preventing means, thereby preventing peeling off and cracks of the impregnated resin.

The above and other objects, features and advantages of the present invention will be more readily apparent from the following detailed description of a few preferred embodiments thereof when taken in conjunction with the accompanying drawings.

DESCRIPTION OF THE PREFERRED EMBODIMENTS

Figure 1:
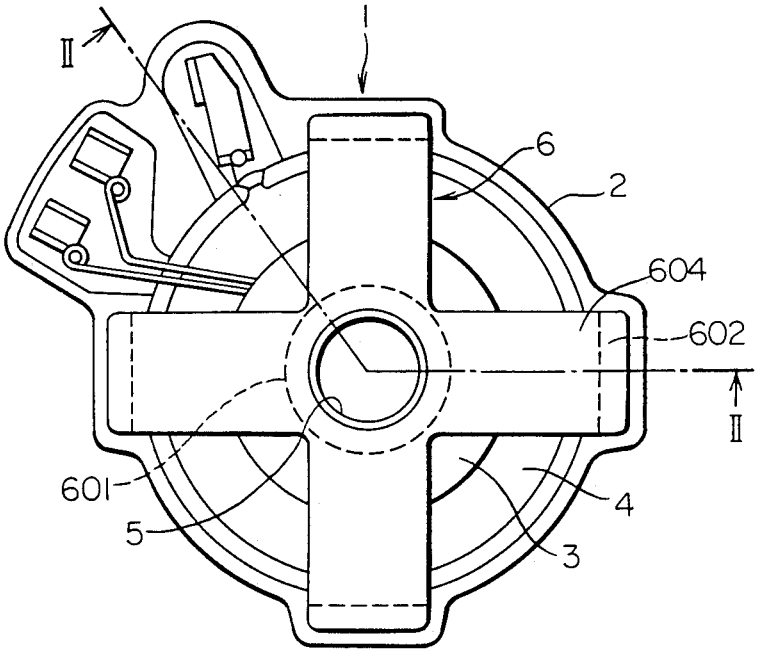
FIG. 1 PRIOR ART
FIG. 1 is a plan view showing a conventional high-voltage transformer for internal combustion engines.

The present invention will now be described in detail with reference to a few presently preferred embodiments thereof as illustrated in the accompanying drawings. In the following description and the figures of the accompanying drawings, the same reference numerals as those employed in FIGS. 1 and 2 designate the same or corresponding parts or members.

Figure 2:
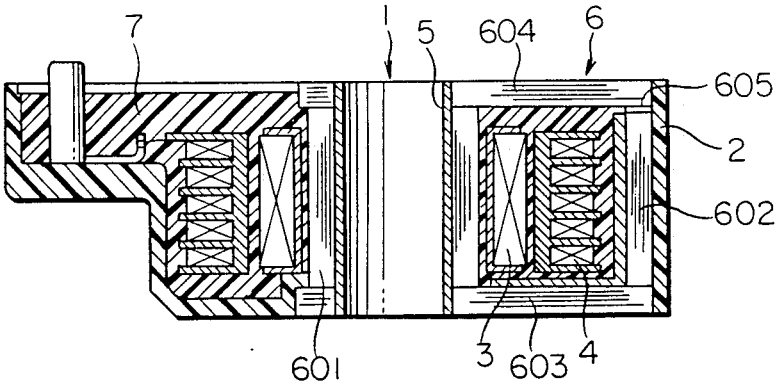
FIG. 2 PRIOR ART
FIG. 2 is a cross sectional view taken on line II—II of FIG. 1.
Figure 3:
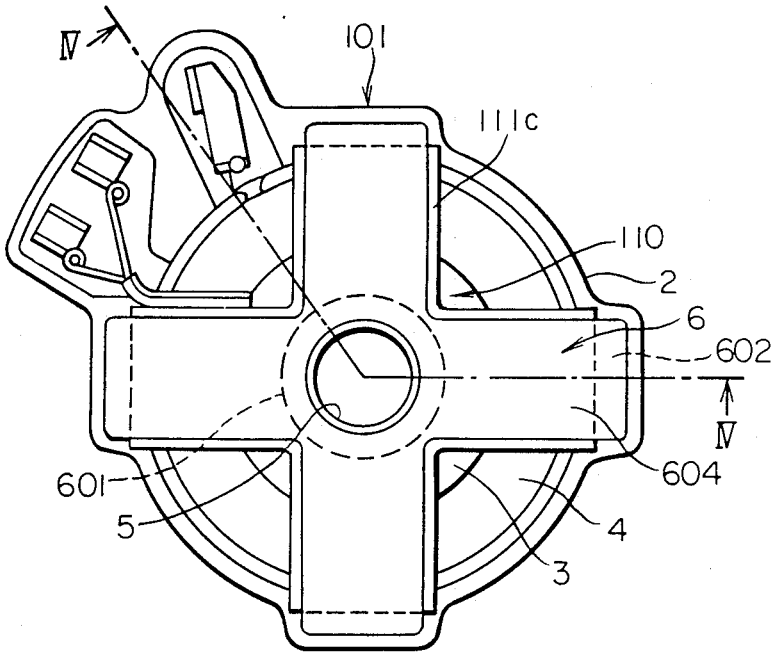
FIG. 3 is a plan view of a high-voltage transformer in accordance with one embodiment of the present invention.
Figure 4:
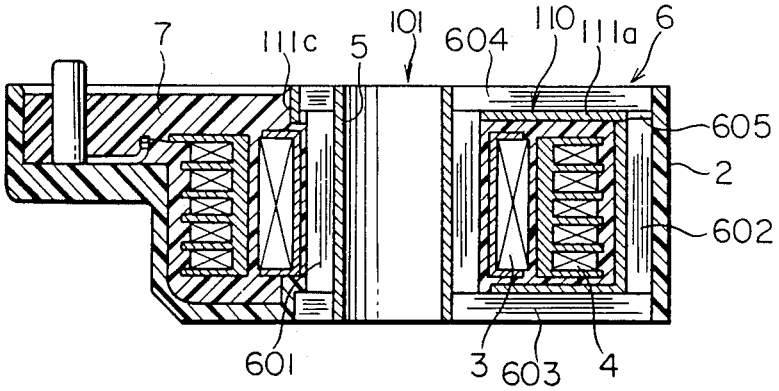
FIG. 4 is a cross sectional view taken on line IV—IV of FIG. 3.
Figure 5:
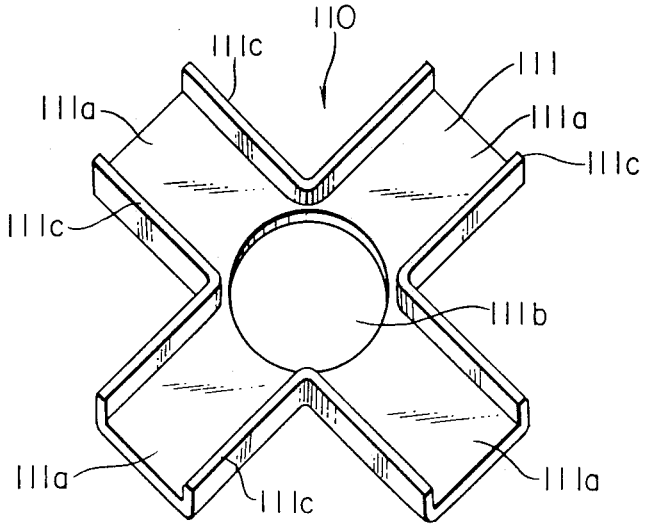
FIG. 5 is a perspective view of a resin-crack preventing member as illustrated in FIG. 3.

Referring first to FIGS. 3 through 5, there is shown a high-voltage transformer 101 in the form of an ignition coil for internal combustion engines which is constructed in accordance with a first embodiment of the present invention. The transformer 101 of this embodiment is substantially similar in construction to the conventional transformer as illustrated in FIGS. 1 and 2 except for the following. Namely, the transformer 101 of this embodiment has a resin-crack preventing means 110 for preventing peeling off and cracking of a resin 7 impregnated into a coil case 2. In this embodiment, the resin-crack preventing means 110 comprises a cross-shaped plate member 111 which is moulded from a resinous material having excellent adhesiveness to the impregnated resin 7 and a coefficient of thermal expansion similar to that of the impregnated resin 7. As clearly seen from FIG. 5, the cross-shaped plate member 111 is similar in planar configuration to a second or upper arm portion 604 of an iron core 6 and has a plurality of (four in the illustrated embodiment) arms 111*a* corresponding to those of the upper arm portion 604 and a circular opening 111*b* formed therethrough at the center thereof for the passage of an annular inner leg portion 601 of the iron core 6. Each of the arms 111*a* of the resin-crack preventing plate member 111 is provided at its opposite sides with flanges 111*c* which are formed integral therewith so as to provide a channel-like cross section. The flanges 111*c* of each arm 111*a* continuously extend along the length of the opposite sides thereof and are integrally connected at the inside corners between adjacent two arms 111*a* with the flanges 111*c* of the adjacent arms 111*a* so as to prevent direct contact between the impregnated resin 7 and the upper side surfaces and the inside corners of the iron core 6.

When the high-voltage transformer 101 as shown in FIGS. 3 and 4 is produced, similar to the conventional high-voltage transformer 1 illustrated in FIGS. 1 and 2, a first or lower cross-shaped arm portion 603 having a cylindrical sleeve 5 fixedly mounted at the center thereof is first disposed in and integrally moulded with or otherwise firmly connected through an appropriate bonding means with the coil case 2. Then, the annular inner leg portion 601, a primary coil 3, a secondary coil 4 and four planar outer leg portions 602 are disposed in the coil case 2, and the resin-crack preventing member 110 is placed on the primary and secondary coils 3 and 4 with the upper end of the annular inner arm portion 601 being passed through the circular opening 111*b* in the member 110. Thereafter, the upper arm portion 604 of the iron core 6 is closely fitted into and firmly held by the flanged resin-crack preventing member 110 with the cylindrical sleeve 5 being passed or inserted into the central circular opening 604*a* in the upper arm portion 604. Thus, the upper arm portion 604 is put on the outer and inner leg portions 601 and 602. In this connection, the radially outer ends of the cross-shaped upper arm portion 604 extend beyond the corresponding arm ends of the cross-shaped resin-crack preventing member 110, and face at their inner or lower surface the upper end surfaces of the outer leg portions 602 with a limited gap 605 formed therebetween, whereas the upper end of the annular inner leg portion 601 is in contact with the inner or lower surface of the upper arm portion 604. The height of the flanges 111*c* of the resin crack preventing member 110 is substantially equal to the thickness of the upper arm portion 604 so that the side surfaces of the upper arm portion 604 are completely covered with the flanges 111*c*, and the upper surface of the upper arm portion 604 is made flush with the upper edges of the flanges 111*c*. Finally, a molten resin 7 is filled into the coil case 2, impregnated inbetween the above members and solidified to firmly install or bond them onto the coil case 2. In this manner, the upper arm portion 604 is firmly secured to the coil case 2 through the resin-crack preventing member 110 and the impregnated resin 7.

In the above-described embodiment, the resin 7 impregnated into the coil case 2 is not in contact with and directly adhered to the side surfaces, the inside corners and the lower or inner surface of the upper arm portion 604, but instead firmly adhered to the resin-crack preventing member 110 which has a coefficient of thermal expansion similar to that of the impregnated resin 7. Thus, the resin 7 will not crack or will not be peeled off from the resin-crack preventing member 110 even when subject to severe temperature changes or great heat shocks.

Figure 6:
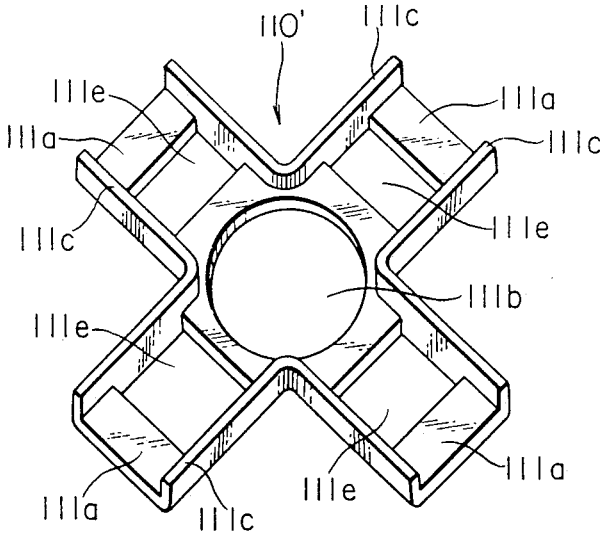
FIG. 6 is a perspective view of a modification of the resin-crack preventing member of FIG. 5.

FIG. 6 shows a modified form of resin-crack preventing member 110' which is substantially similar to the member 110 of FIG. 5 except for the fact that a notch 111*e* is formed in each arm 111*a* of the cross-shaped plate member 111.

Figure 7:
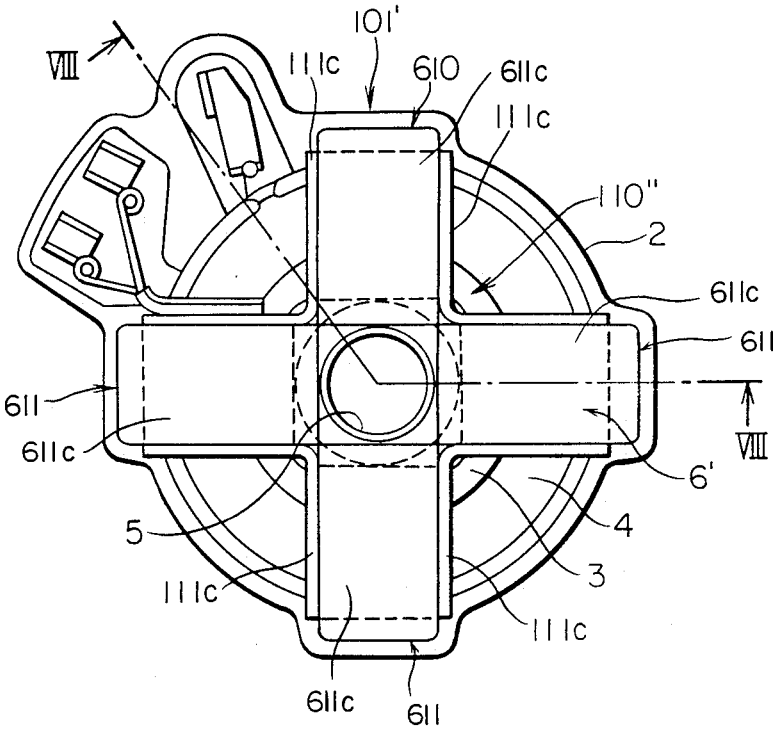
FIG. 7 is a plan view of a high-voltage transformer in accordance with another embodiment of the present invention.
Figure 8:
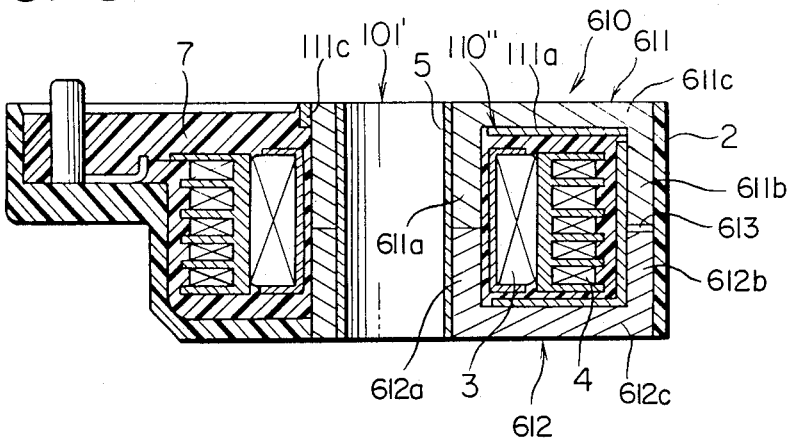
FIG. 8 is a cross sectional view taken on line VIII—VIII of FIG. 7.
Figure 9:
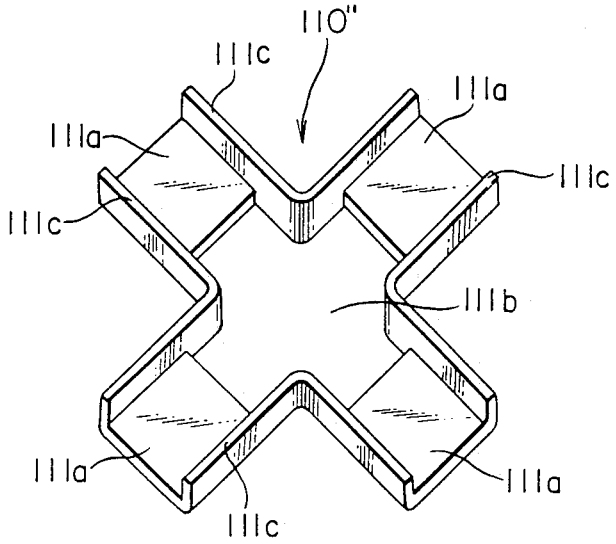
FIG. 9 is a perspective view of a resin-crack preventing member as illustrated in FIG. 7.

FIGS. 7 through 9 show a high-voltage transformer 101' having a resin crack preventing member 110'' in accordance with another embodiment of the present invention. In this embodiment, an iron core 6' comprises a plurality of (four in the illustrated embodiment) iron core sections 610 which are disposed around a cylindrical sleeve 5 so as to form a cross-shaped configuration. Each of the iron core sections 610 is composed of a pair of first (or lower) and second (or upper) channel-shaped core members 612 and 611. Each of the lower and upper core members 612 and 611 has a planar inner leg portion 611*a* or 612*a* which is disposed around the cylindrical sleeve 5 and radially inside a primary coil 3, a planar outer leg portion 611*b* or 612*b* which is disposed radially outside a secondary coil 4, and an intermediate arm portion 611*c* or 612*c* interconnecting the inner and outer leg portions 611*a* and 611*b* or 612*a* sand 612*b*. The outer leg portion 611*b* or 612*b* is slightly shorter than the inner leg portion 611*a* or 612*a* so that when the upper and lower core members 611 and 612 are assembled to form a iron core section 610, the lower end surface of the inner leg portion 611*a* of the upper core member 611 is placed in contact with the upper end surface of the inner leg portion 612*a* of the lower core member 612, whereas the lower end surface of the outer leg portion 611*b* of the upper core member 611 is placed in a spaced face-to-face relation with the upper end surface of the outer leg portion 612*b* of the lower core member 612 with a limited gap 613 formed therebetween. Thus, a closed magnetic path is formed through these upper and lower core members 611 and 612 when the primary and secondary coils 3 and 4 are energized.

The resin-crack preventing member 110″ in this embodiment is substantially similar in construction and operation to the member 110 of the previous embodiment illustrated in FIG. 5 except for the fact that it has a generally cross-shaped opening 111*b′* formed therethrough at the center thereof.

When the high-voltage transformer 101′ shown in FIGS. 7 and 8 is produced, the lower core members 612 is first disposed and integrally moulded with or otherwise fixedly connected with the coil case 2, and then the primary coil 3 and the secondary coil 4 are disposed in the coil case 2. Thereafter, the cross-shaped resin-crack preventing member 110″ is placed on the primary and secondary coils 3 and 4, and the upper core members 611 are fitted into and firmly held by the respective arms of the resin-crack preventing member 110″ so that the inner leg portion 611*a* and the outer leg portion 611*b* of each upper core member 611 extend downwards from the radially inner and outer ends of each arm of the resin-crack preventing member 110″, respectively. In this manner, the lower end surface of the inner leg portion 611*a* of the upper core member 611 is in contact with the upper end surface of the inner leg portion 612*a* of the corresponding lower core member 612, whereas the lower end surface of the outer leg portion 611*b* of the upper core member 611 is in a spaced face-to-face relation with the upper end surface of the outer leg portion 612*b* of the corresponding lower core member 612, as clearly seen from FIG. 8. Then, a molten resin 7 is filled into the coil case 2, impregnated inbetween the above members in the coil case 2 and solidified to firmly bond or secure them to the coil case 2.

In this embodiment, similar to the previously described embodiment illustrated in FIGS. 3 through 5, the impregnated resin 7 is prevented from direct contact with the side surfaces, the inside corners and the lower surfaces of the upper core members 611 by means of the resin-crack preventing member 110″. As a result, peeling off and cracking of the impregnated resin 7 in the vicinity of these portions of the upper core members 611 can be effectively avoided. In addition, the upper core members 611, though not directly adhered to the resin 7, are firmly secured to the coil case 2 through the resin-crack preventing member 110″ and the impregnated resin 7.

Figure 10:
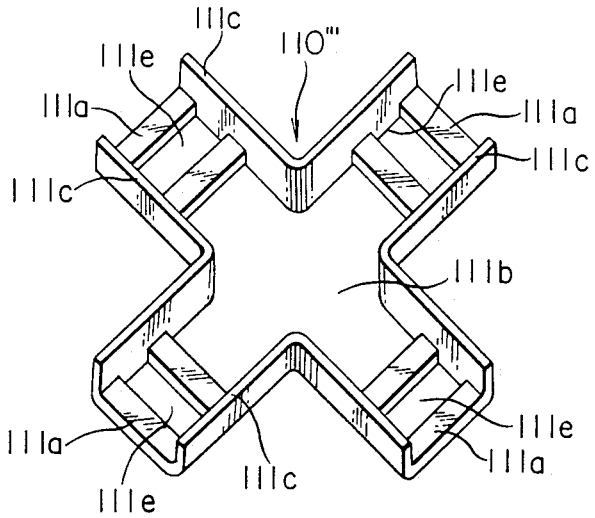
FIG. 10 is a perspective view of a modification of the resin-crack preventing member of FIG. 9.

FIG. 10 shows a modified form of resin-crack preventing member 110‴ which is substantially similar in construction and operation to the member 110″ of FIG. 9 except for the fact that a notch 111*e* is formed in each arm 111*a* of the cross-shaped plate member 111.

Here, it should be noted that although some examples of a resin-crack preventing member have been shown and described herein, it may take any appropriate configuration other than the above in accordance with the configuration of an iron core.

What is claimed is:

1. A high voltage transformer comprising:

a coil case;

a primary coil in said coil case;

a secondary coil disposed in said coil case to surround said primary coil;

a cylindrical sleeve disposed in and fixedly mounted on said coil case substantially at the center thereof for receiving a rotary shaft;

an iron core disposed in said coil case around said sleeve so as to surround said primary coil and said secondary coil and forming a closed magnetic flux path passing through said primary and secondary coils when these coils are energized;

a resin impregnated in said coil case electrically insulating said coils from said iron core and securing said coils and said iron core to said coil case; and a resin-crack preventing member disposed between said impregnated resin and said iron core to prevent the peeling off and cracking of said resin, said member being a moulded resinous member adhered to said resin and having a coefficient of thermal expansion substantially the same as that of said resin.

2. A high-voltage transformer as claimed in claim 1, wherein said iron core comprises:

a pair of first and second cross-shaped arm portions, said first arm portion being integrally connected with said coil case and mounting thereon said coils, said second arm portion being disposed above said coils;

an annular inner leg portion disposed around said cylindrical sleeve and being in contact at its opposite ends with first and second arm portions, said inner leg portion being disposed radially inside said primary coil; and a plurality of planar outer leg portions disposed radially outside said secondary coil, said outer leg portions being in contact at their one end with said first arm portion and disposed at their other end in a spaced face-to-face relation with said second arm portion; and wherein said resin-crack preventing member is provided on the inside corners of said cross-shaped second arm portion between its adjacent cross arms.

3. A high-voltage transformer as claimed in claim 2, wherein said resin-crack preventing member is further provided on the side surfaces of said second arm portion.

4. A high-voltage transformer as claimed in claim 2, wherein said resin-crack preventing member is further provided on the inner surface of said second arm portion which faces said first arm portion.

5. A high-voltage transformer as claimed in claim 2, wherein said resin-crack preventing member comprises a cross-shaped plate member moulded from a resinous material which is highly adhesive to said resin, said cross-shaped plate member being provided at its sides with flanges which prevent direct contact of said second arm portion with said impregnated resin, said second arm portion being fitted into and firmly held by said cross-shaped plate member.

6. A high-voltage transformer as claimed in claim 5, wherein said cross-shaped plate member has a circular opening formed at the center thereof for passage of said rotary shaft.

7. A high-voltage transformer as claimed in claim 6, wherein said cross-shaped plate member has a notch formed in each arm portion thereof.

8. A high-voltage transformer as claimed in claim 1, wherein said iron core comprises:

a plurality of pairs of first and second iron core sections each in the form of a channel and disposed around said cylindrical sleeve in a cross-shaped manner, said first core sections being integrally connected with said coil case and mounting thereon said coils, said second core sections being disposed on said corresponding first core sections so as to surround said primary and secondary coils, each of said first and second core sections having an inner leg portion disposed along the outer surface of said cylindrical sleeve and radially inside said primary coil, an outer leg portion disposed radially outside said secondary coil, and an intermediate arm portion interconnecting said inner and outer leg portions, said outer leg portion being slightly shorter than said inner leg portion so that when the corresponding first and second core sections are assembled, the adjacent end surfaces of said inner leg portions of said first and second core sections are in contact with each other, whereas the adjacent end surfaces of said outer leg portions of said first and second core sections are in a spaced face-to-face relation with each other with a limited gap formed therebetween;

wherein said resin-crack preventing member is provided on the inside corners of said second core sections.

9. A high-voltage transformer as claimed in claim 8, wherein said resin-crack preventing member is further provided on the side surfaces of said second core sections.

10. A high-voltage transformer as claimed in claim 9, wherein said resin-crack preventing member is further provided on the inner surfaces of said second core sections which face said first core sections.

11. A high-voltage transformer as claimed in claim 8, wherein said resin-crack preventing member comprises a cross-shaped plate member moulded from a resinous material which is highly adhesive to said resin, said cross-shaped plate member being provided at its sides with flanges which prevent direct contact of said second core sections with said impregnated resin, said second core sections being fitted into and firmly held by said cross-shaped plate.

12. A high-voltage transformer comprising:

a coil case;

a primary coil in said coil case;

a secondary coil disposed in said coil case to surround said primary coil;

a cylindrical sleeve disposed in and fixedly mounted on said coil case substantially at the center thereof for receiving a rotary shaft;

an iron core disposed in said coil case around said sleeve so as to surround said primary coil and said secondary coil and form a closed magnetic flux path passing through said primary and secondary coils when these coils are energized;

a resin impregnated in said coil case electrically insulating said coils from said iron core and securing said coils and said iron core to said coil case;

a resin-crack preventing member disposed between said impregnated resin and said iron core, to prevent the peeling off and cracking of said resin;

said iron core comprising:

a plurality of pairs of first and second iron core sections each in the form of a channel and disposed around said cylindrical sleeve in a cross-shape, said first core sections being integrally connected with said coil case and mounting thereon said coils, said second core sections being disposed on said corresponding first core sections so as to surround said primary and secondary coils, each of said first and second core sections having an inner leg portion disposed along the outer surface of said cylindrical sleeve and radially inside said primary coil, an outer leg portion disposed radially outside said secondary coil, and an intermediate arm portion interconnecting said inner and outer leg portions, said outer leg portion being slightly shorter than said inner leg portion so that when the corresponding first and second core sections are assembled, the adjacent end surfaces of said inner leg portions of said first and second core sections are in contact with each other, whereas the adjacent end surfaces of said outer leg portions of said first and second core sections are in a spaced face-to-face relation with each other with a limited gap formed therebetween;

said resin-crack preventing member comprising a moulded cross-shaped resinous plate member adhered to said resin and which has a coefficient of thermal expansion substantially the same as that of said resin impregnated into said coil case, said cross-shaped resinous plate member being provided at its sides with flanges which prevent direct contact of said second core sections with said impregnated resin, said second core sections being fitted into and firmly held by said cross-shaped resinous plate member, and wherein said cross-shaped resinous plate member has an opening formed at the center thereof permitting passage of said rotary shaft.

13. A high-voltage transformer as claimed in claim 12, wherein said cross-shaped plate member has a notch formed in each arm portion thereof.

* * * * *